US010493351B2

(12) United States Patent
Glasner et al.

(10) Patent No.: US 10,493,351 B2
(45) Date of Patent: Dec. 3, 2019

(54) ILLUMINATED ROTATING DANCE POLE

(71) Applicant: Flickerpole LLC, Cape Canaveral, FL (US)

(72) Inventors: James Glasner, Cocoa Beach, FL (US); Mark Nelson, Cocoa Beach, FL (US)

(73) Assignee: Flicker Pole L.L.C., Cape Canaveral, FL (US)

( * ) Notice: Subject to any disclaimer, the term of this patent is extended or adjusted under 35 U.S.C. 154(b) by 233 days.

(21) Appl. No.: 15/478,264

(22) Filed: Apr. 4, 2017

(65) Prior Publication Data

US 2017/0282045 A1 Oct. 5, 2017

Related U.S. Application Data

(60) Provisional application No. 62/317,904, filed on Apr. 4, 2016.

(51) Int. Cl.
*A63B 71/06* (2006.01)
*A63B 9/00* (2006.01)

(52) U.S. Cl.
CPC ..... *A63B 71/0622* (2013.01); *A63B 9/00* (2013.01); *A63B 2244/225* (2013.01)

(58) Field of Classification Search
CPC ... A63B 9/00; A63B 71/0622; A63B 2207/02; A63B 2225/50; A63B 2244/225
See application file for complete search history.

(56) References Cited

U.S. PATENT DOCUMENTS

| | | | | |
|---|---|---|---|---|
| 8,006,417 | B2 | 8/2011 | Montell | |
| 8,137,243 | B2 * | 3/2012 | Coote | A63B 9/00 248/354.1 |
| 8,240,071 | B2 | 8/2012 | Montell | |
| 2007/0036650 | A1 * | 2/2007 | Lau | F03D 3/005 416/5 |
| 2007/0293372 | A1 * | 12/2007 | Kessler | A63B 9/00 482/51 |
| 2008/0123362 | A1 * | 5/2008 | Thorneycroft | F21V 21/13 362/558 |
| 2008/0146423 | A1 * | 6/2008 | Ammon | A63B 9/00 482/131 |
| 2010/0179029 | A1 * | 7/2010 | Ochi | A63B 9/00 482/35 |
| 2013/0207572 | A1 * | 8/2013 | Tucker | H05B 37/02 315/297 |

* cited by examiner

*Primary Examiner* — Joshua Lee
(74) *Attorney, Agent, or Firm* — Wiggin and Dana LLP; Gregory S. Rosenblatt

(57) ABSTRACT

A dance pole effective to bear the weight of a dancer has a rigid inner core and a transparent outer tube circumscribing the rigid inner core. A first portion of an outer surface of the rigid inner core contacts an inner wall of the transparent outer tube and a second portion of the outer surface is recessed from the inner wall. A plurality of lighting points, such as strips of light emitting diodes, is disposed on the second portion of the outer surface.

15 Claims, 8 Drawing Sheets

ILLUMINATED ROTATING DANCE POLE

CROSS-REFERENCE TO RELATED PATENT APPLICATION

This patent application claims a benefit to U.S. Provisional Patent Application Ser. No. 62/317,904, titled "Illuminated Rotating Dance Pole," by James Glasner et al., that was filed on Apr. 4, 2016. The disclosure of U.S. 62/317,904 is incorporated by reference herein in its entirety.

BACKGROUND OF THE DISCLOSURE

A typical dance pole is a hollow brass pole approximately 8 feet in length that extends from a floor to a ceiling. Metal tubes having a diameter of around 2 inches are generally well suited for the typical uses of dancers. The diameter is sufficient to provide adequate stiffness, friction, and appearance at a reasonable cost. Larger diameters are generally usually less suitable to accommodate a user's hands. Both fixed and rotating metal dance poles are widely used. Polished brass and stainless steel are widely used for dance poles. An assortment of coatings may be applied over these metals to accommodate the decor of nightclubs, dance studios and homes. Metals other than brass and stainless may be employed. However, for proper use, deflection of the pole must be minimized when force is applied to it via a dancer. Especially for professional use, repeated acrobatics must be accommodated without excessive deflection or deformation. For this reason, many non-metallic materials are poorly suited for use in dance poles, as are materials that cannot be easily made smooth and non-splintering. A disadvantage of metal poles is that they are opaque. Decorative features cannot be inserted in the metal poles for viewing external to the poles.

Certain composite materials, such as fiberglass and carbon fiber, have sufficient strength and flex properties for use as dance poles, however, these composites, as with metals, are opaque.

Previous non-metallic designs include solid transparent plastic dance poles with illumination provided from above and/or below the pole. However, these poles are not sufficiently rigid and suffer from undesired deflection during use when of the necessary height. Hollow tubes containing illumination would suffer from even worse and unsatisfactory deflection.

There remains, therefore, a need for a dance pole having sufficient strength and flex resistance for extended use that enables internal decoration, including lighting.

BRIEF SUMMARY

A dance pole effective to bear the weight of a dancer has a rigid inner core and a transparent outer tube circumscribing the rigid inner core. A first portion of an outer surface of the rigid inner core contacts an inner wall of the transparent outer tube and a second portion of the outer surface is recessed from the inner wall. A plurality of lighting points, such as strips of light emitting diodes, is disposed on the second portion of the outer surface.

DETAILED DESCRIPTION

Figure 1:
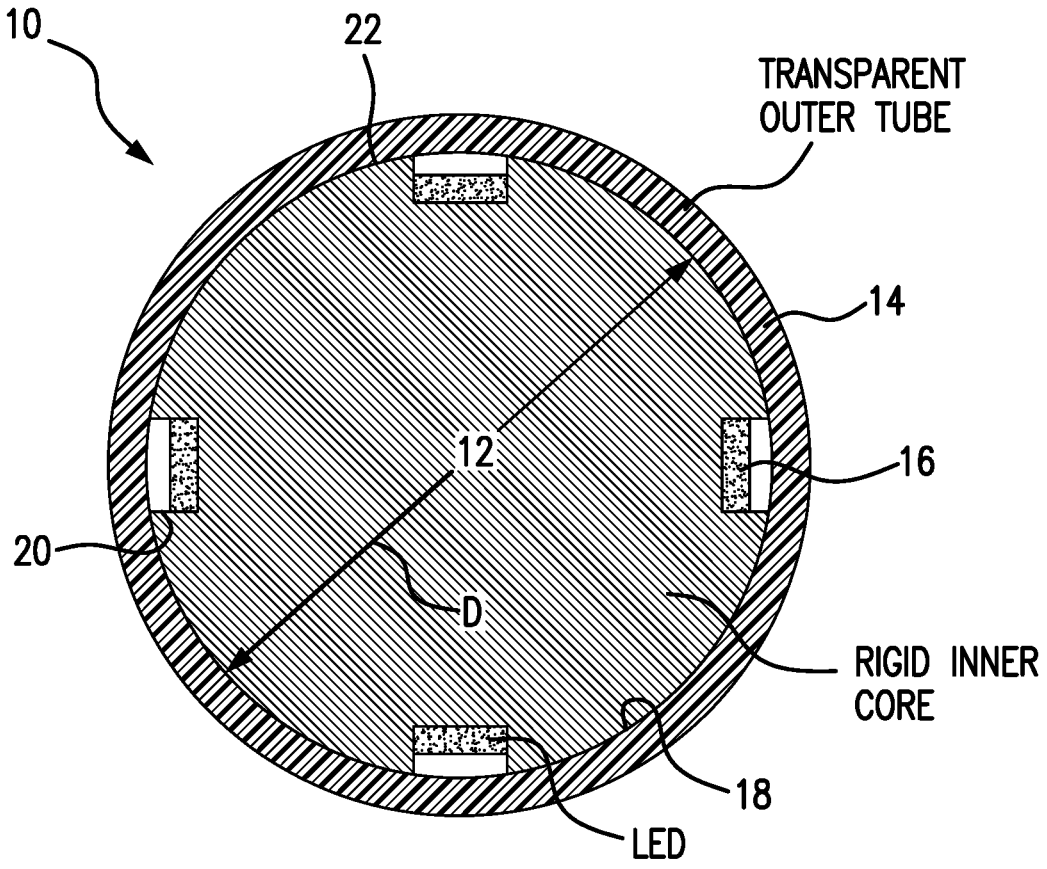
FIG. 1 is a top view schematic illustration of a dance pole having recessed LEDs in accord with a first embodiment disclosed herein.

Disclosed is an internally illuminated dance pole that is sufficiently rigid for acrobatics. In a first embodiment, as illustrated in FIG. 1, the dance pole 10 has a rigid inner core 12 that is circumscribed by a transparent outer tube 14. The inner core provides substantially all of the dance pole 10 rigidity and houses illumination devices 16. One exemplary illumination device 16 is light emitting diodes (LEDs). As discussed below, the transparent outer tube 14, a base and a top may be configured to rotate on bushings and/or bearings as a unit. Bushings may optionally support the transparent outer tube 14 while also enabling several LED strips to pass through them.

Without limitation, materials suited for the transparent outer tube 14 include polycarbonate, acrylic, butyrate and polyvinyl chloride. Other plastics may be suitable as well. The rigid inner core 14 is preferably a metal or metal alloy, but may also be fiberglass, carbon fiber or other material that provides sufficient rigidity to the pole during use and within the confines that the pole must be sized to extend from floor to ceiling and accommodate dancers' hands.

In this first embodiment, the rigid inner core 12 has a circular cross section and a diameter, D, about equal to an inside diameter of the transparent outer tube 14. There is support and preferably continuous contact at least at periodic intervals between the transparent tube and the metal core. The diameter, D, is selected to support the transparent outer tube 14 without engaging the inner wall 18 such that one of the rigid inner core 12 and transparent outer tube 14 may rotate independent of the other. Alternatively, the transparent outer tube 14 may engage the inner wall 18 such that the rigid inner core 12 and transparent outer tube 14 rotate together. The exact dimensions of the rigid inner core 12 are dependent on the specific illumination devices, power connections and control devices.

Cavities 20 are spaced around the circumference 22 of the rigid inner core 12. The cavities 20 are typically evenly radially spaced around the circumference, although symmetry is not required. Exemplary numbers of cavities could be 6, 8, 10, 12, etc. The cavities 20 have a minimum depth sufficient to receive a strip of LEDs 16. Preferably, the cavity 20 depth is sufficient for the LEDs 16 to be recessed relative to the circumference 22 of the rigid inner core 12 to avoid bearing any load on the LEDs. In one exemplary embodiment, there are six ⅛ inch deep by 0.4 inch wide cavities 20 to accommodate conventional strips of LEDs 16, though other dimensions and number of cavities may be employed.

Figure 2:
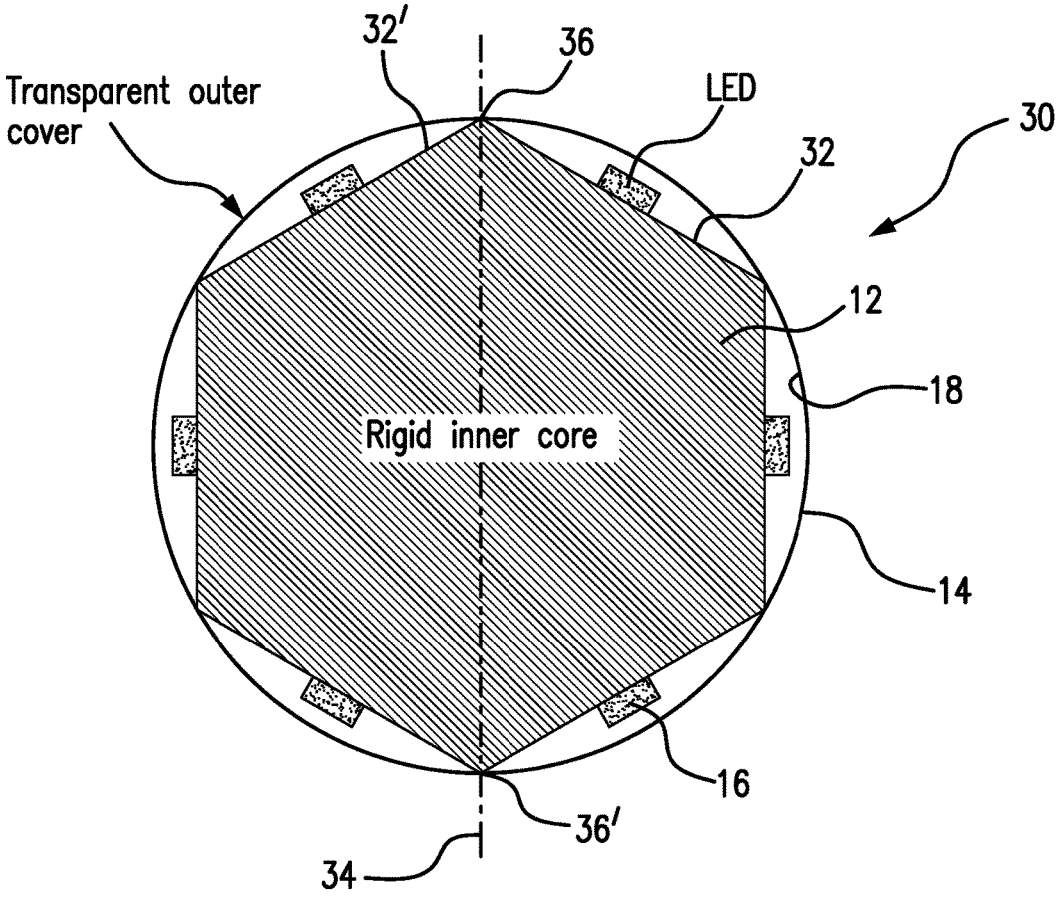
FIG. 2 is a top view schematic illustration of a dance pole having recessed LEDs in accord with a second embodiment disclosed herein.

In a second embodiment, as illustrated in FIG. 2, a dance pole 30 has a rigid inner core 12 with a polygonal cross section. The number of flats 32 preferably matches the number of LED 16 strips desired. An axis 34 connecting two apexes 36, 36' formed by an intersection of two adjoining flats 32, 32' where the two apexes 36, 36' are separated by 180°, has a length effective to support the transparent outer tube 14 without engaging the inner wall 18 such that one of the rigid inner core 12 and transparent outer tube 14 may rotate independent of the other. Alternatively, the transparent outer tube 14 may engage the inner wall 18 such that the rigid inner core 12 and transparent outer tube 14 rotate together. The exact dimensions of the rigid inner core 12 are dependent on the specific illumination devices, power connections and control devices.

Figure 3:
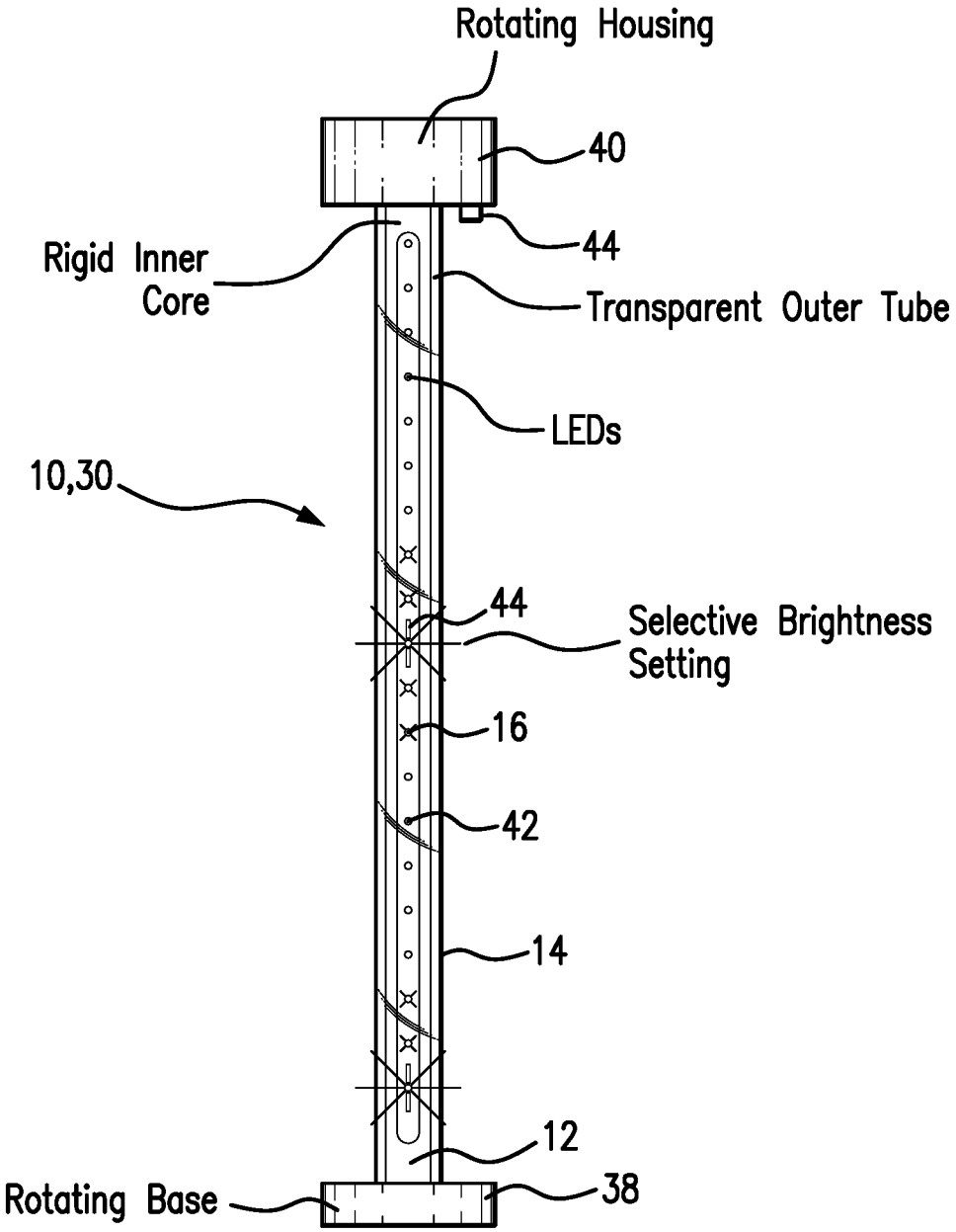
FIG. 3 is a side schematic illustration of a dance pole illustrating selective brightness settings in recessed LEDS, a rotating base and sensors to influence the lighting points.

With reference to FIG. 3, embodiments may employ either or both of a rotating rigid inner core 12 and rotating transparent outer tube 14. Likewise, one or both may be non-rotating. For example, without limitation, in certain embodiments, the rigid inner core 12 is fixed with fixed LEDs 16 while scalloped bushings allow the transparent outer tube 14 to rotate around the rigid inner core. These bushings allow the transparent outer tube 14 to spin over the rigid inner core 12 and transfer a dancer's load to the rigid inner core while allowing the strips of LEDs 16 to be attached to the rigid inner core. This allows fixed power and signals from a power supply and computer or processor to be sent to the LEDs 16 and yet still have the outer transparent tube 14 spin. In such an embodiment conventional bearings may be employed. In other embodiments, the dance pole 10, 30 pole is fixed with both a rigid inner core 12 and a transparent outer tube 14 that do not rotate.

Figure 4:
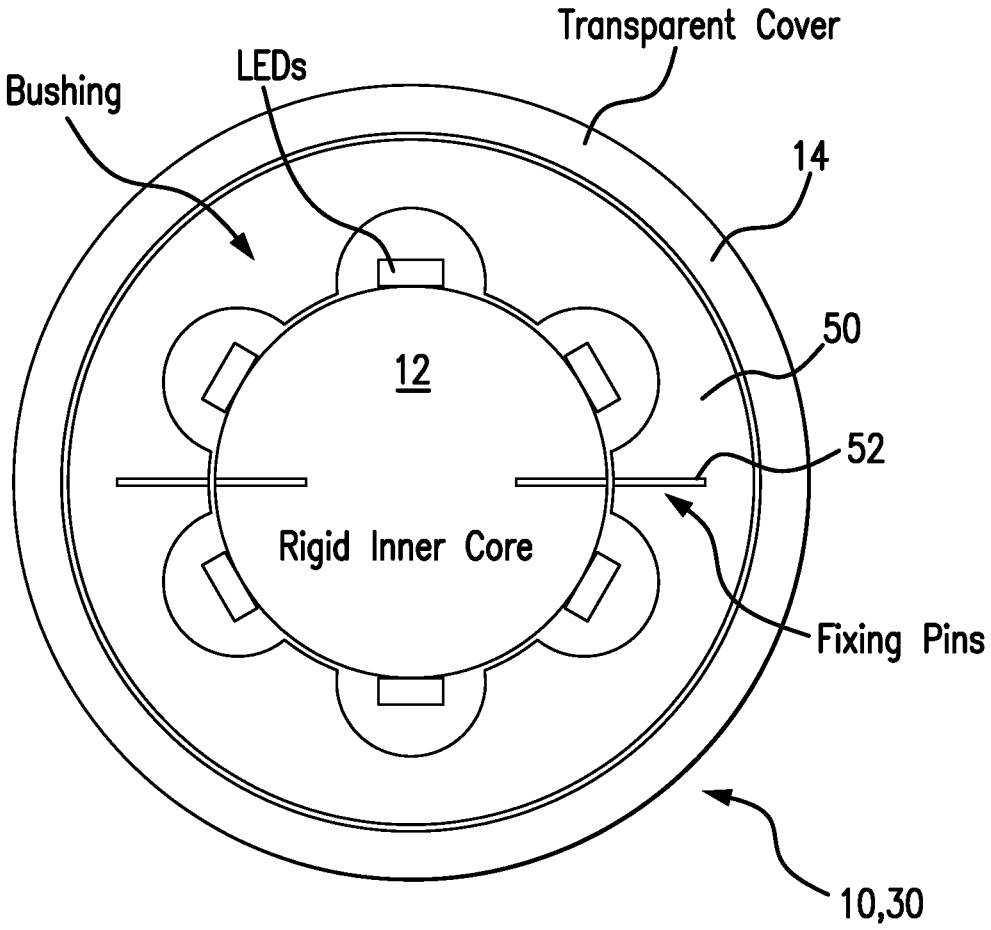
FIG. 4 is a top view schematic illustration of a bushing enabling a transparent outer tube to rotate on fixed rigid inner core.
Figure 5:
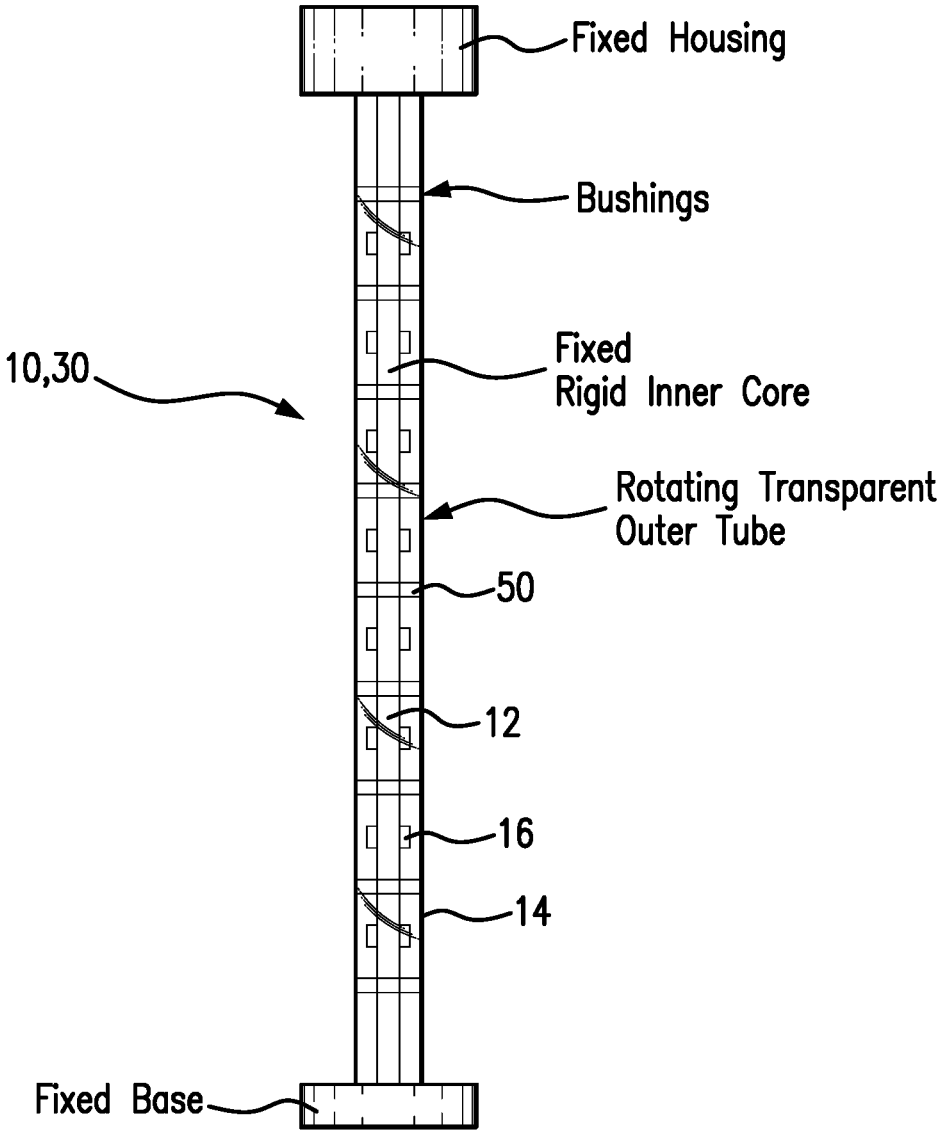
FIG. 5 is a side schematic illustration showing an alignment for a plurality of bushings.

FIG. 4 is a top view schematic illustration of a bushing 50 enabling a transparent outer tube 14 to rotate on fixed rigid inner core 12. The bushing may be formed from any suitable, low friction, material, such as bronze or a durable plastic. One exemplary material is high density polyethylene (HDPE). Fixing pins 52 engage the rigid inner core 12 to hold the bushing 50 in place. Referring to FIG. 5, a plurality of bushings 50 are vertically spaced along the fixed rigid inner core 12 to both support the transparent outer tube 14 while not impeding visibility of the LEDs 16. The number of bushings 50 is as-need. An exemplary number of bushings is ten.

Referring back to FIG. 3, a computer and/or processor for controlling the lighting 16 and/or other functionality may be remote from or integrated with the dance pole 10, 30. The computer and/or processor can run on a fixed program or can respond to stimulus such as a keyboard, switches or other input to vary the program or switch between programs. A controller takes the computer/processor output and performs timing and routing operations to get the computer signals to the appropriate LEDs 16. Various illumination schemes may be employed. For instance varying patterns or colors may be employed. Furthermore, different areas of the pole may be illuminated to different degrees. In certain embodiments, sensors 44, 44' may be employed to control which areas of the pole are illuminated and to what to degree, which may for instance receive or detect signals or other conditions such as pressure or heat. In such embodiments, the intensity of lighting may be adjusting based on the duration and/or intensity of the signals or conditions. For instance, lighting of the dance pole 10, 30 may, without limitation, include a constant lower level of lighting with increased lighting in areas according to the degree of contact they receive. Together, the computer and/or processor, controller and any associated connecting wires are referred to herein as the "electronics." The internal illumination can be controlled directly while the dance pole 10, 30 is in operation. In certain embodiments the computer processor may be controlled wirelessly.

The programmable LEDs 16 and any associated electronic equipment, depending on the particular embodiment, require a power source. Different embodiments may provide power to the lighting 16 in varying ways. In certain embodiments, the power source is integral batteries and the entire dance pole 10, 30 is configured to spin. In such a configuration, rechargeable batteries may be employed and the dance pole converted to run between ball bearing turntables. Inductive charging or provision of power may be accomplished in other embodiments by the use of inductive coils.

Figure 6:
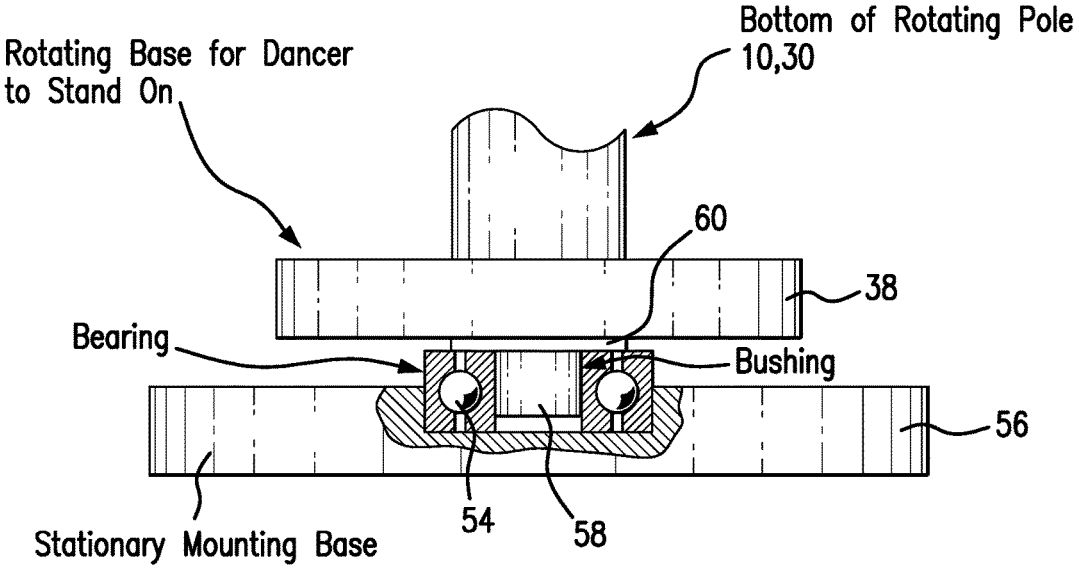
FIG. 6 is a block diagram illustrating components for a rotating base that may be utilized with the dance pole.

With reference to FIG. 6, certain embodiments include a rotating base 38, a dancer can stand on this rotating base 38 at the base 60 of the dance pole 10, 30 and hold on to the dance pole 10, 30 while both are rotated together. A bearing 54 mounted in a stationary mounting base 56 enables free rotation of bushing 58 that is mounted to the base 60 of the dance pole.

Figure 7:
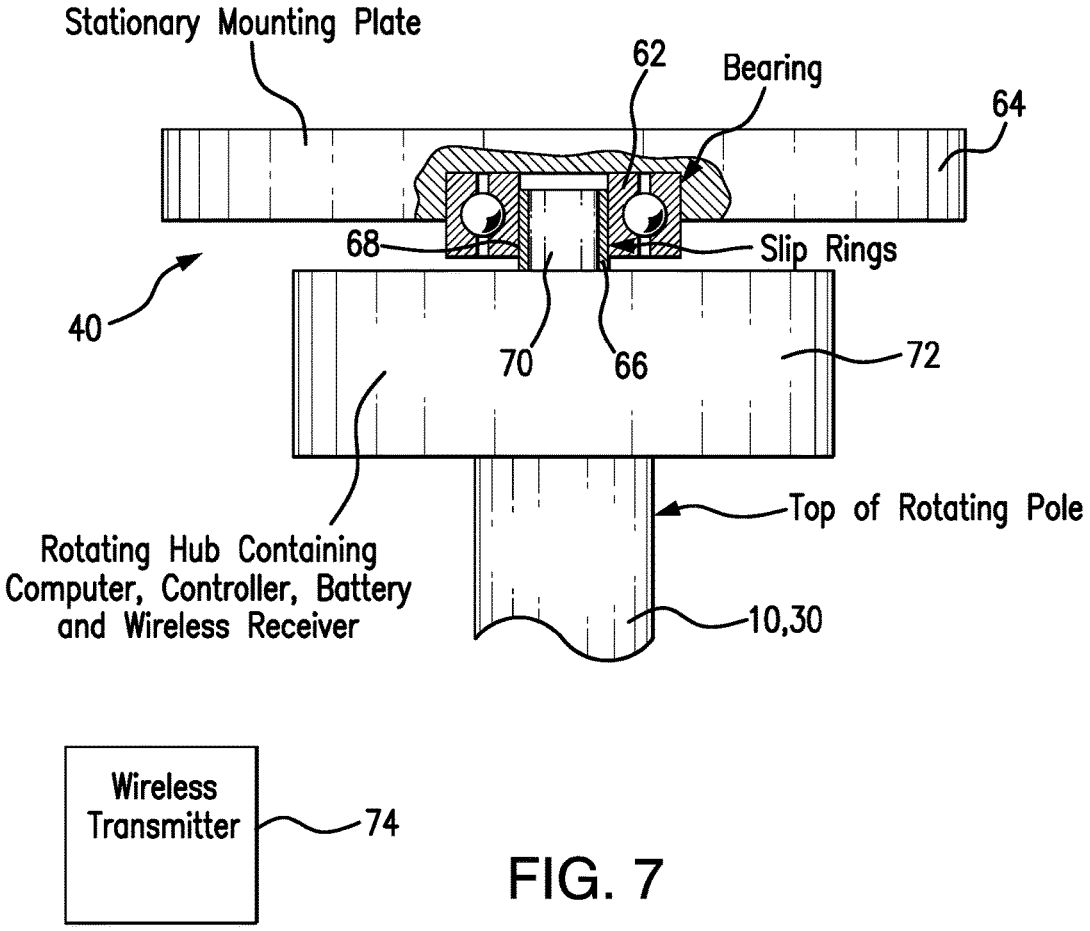
FIG. 7 is a block diagram illustrating components for a housing that may be utilized at the top of the dance pole in accordance with one embodiment.
Figure 8:
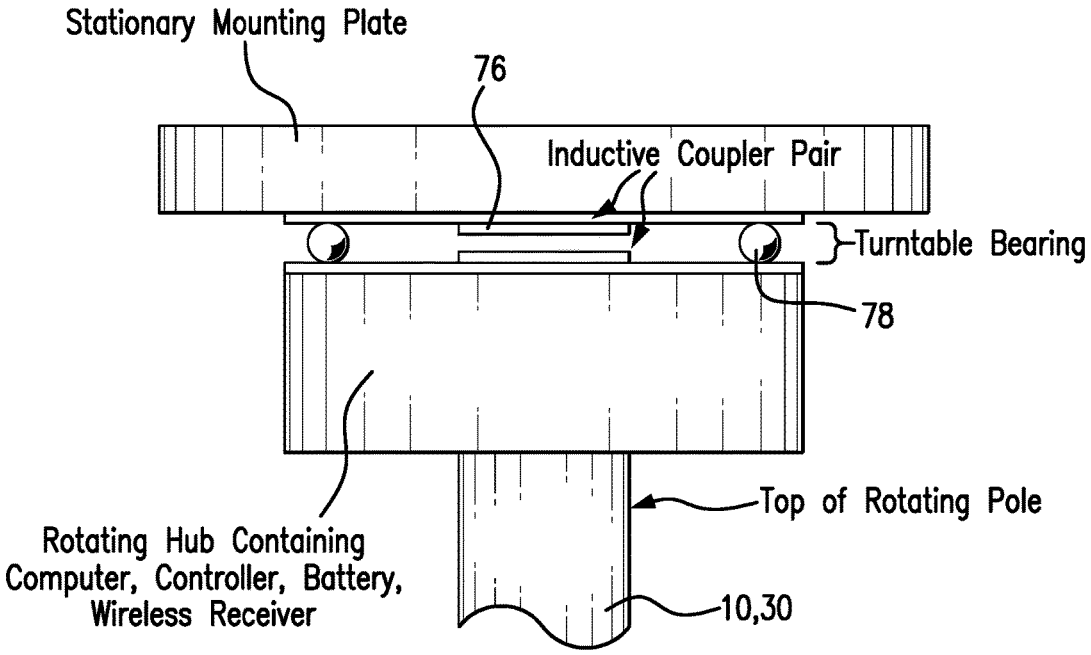
FIG. 8 is a block diagram illustrating components for a housing that may be utilized at the top of the dance pole in accordance with an alternative embodiment.

FIGS. 7 and 8 illustrate alternative embodiments that further, or instead, include a rotating housing 40 attached to the top of the dance pole 10, 30. The rotating base, rigid inner core, LEDs, bushings, transparent outer tube, electronics and the housing 40 can optionally all turn together. Optionally attachment points are employed such that the entire rotating assembly runs between turntable bearings. The bearings may be attached to mounting plates that are be attached to the floor and ceiling. Optionally, a faceted metal shaft may be employed.

FIG. 7 is a block diagram illustrating components for a rotating housing 40 that may be utilized at the top of the dance pole 10, 30. A bearing 62 is affixed to a stationary mounting plate 64. A slip ring 66, typically formed from graphite or a metal contact brush rubs on the outside diameter of a rotating metal conductor 70 to provide electrical power to a rotating hub 72 that rotates with the dance pole 10, 30. Without limitation, one or more of a computer, controller, battery (preferably rechargeable to avoid a need to disassemble the housing 40 and replace exhausted batteries) and a wireless receiver may be contained within the rotating hub.

A wireless transmitter 74 controlled by a disc jockey, external computer, or other source may be in wireless communication with the wireless receiver contained with rotating hub 72. In this embodiments, slip rings are employed. Continuous external power may be provided, allowing for uninterrupted use, even though the dance pole 10, 30 is configured to rotate freely. Utilizing wireless communication, the dance poles may communicate with controllers and/or with other dance poles through various protocols. In one embodiment, a wireless keyboard tells the computer what light pattern to run. Also, many nightclubs use a protocol called DMX512 to control lighting. In another embodiment, DMX512 signals instruct a computer what light pattern to run. DMX512-A is communication protocol utilized to control digital communication and used to control stage lighting. The current standard and is maintained by ESTA (Entertainment Services and Technology Association, New York, N.Y.).

In FIG. 8, the power source may be inductive, with power provided to the dance pole 10, 30 by inductive coils 76 that may be integrated with a turntable 78.

The disclosed subject matter has several advantages. Dancers can perform acrobatics (i.e., impart side and end loads on the dance pole and rotating base) without undesirable deflection or deformation of the dance pole. Also, it is visually exciting enough to compete and surpass with the appearance of conventional metal poles. A smooth external surface and proper rotation, where desired, may be maintained.

Referring back to FIG. 3, in some embodiments configured for rotation, the dance pole 10, 30 has a top and a bottom bearing. Generally, power and/or signal communication to/from the lighting 16 may be accomplished at either or both of the top and bottom bearings. In certain embodiments, the housing 40 at the top of the dance pole contains a computer and controller for controlling the illumination 16. The housing 40 is concentric with a vertical axis of the dance pole and transfers any load on the dance pole to the top bearing.

In another embodiment, the dance pole is has a rigid inner core having a plurality of perforations 42. The perforations 42 are covered with a transparent coating to maintain a smooth surface. The lighting 16 is placed to align with the perforations 42.

The LEDs 16 may be positioned inside the transparent outer tube 14 in several ways including through the use of scalloped bushings or the use of facets (including hexagonal). The bushing method may be employed with certain other materials to reduce drag. The faceted method may include extruding the metal core in various shapes.

In summary, the dance pole described herein is not just an illuminated pole, rather an ultimate pole that does many things. As an exemplary, but not limiting list, the preferred dance pole is both illuminable and programmable, has a diameter of not over 2 inches, is stiff enough for acrobatics, it is rotatable, it has a rotating base for a beginning dancer to step on, and it is reliable, i.e. works day after day after day. The outer tube is seamless, tough and smooth. The dance pole is controllable from a distance and able to be tied into a nightclub's lighting system. And, finally, it is capable of interacting with the dancer and/or music.

We claim:

1. A dance pole effective to bear the weight of a dancer, comprising:

a rigid inner core having an outer surface;

a transparent outer tube circumscribing the rigid inner core, a first portion of the outer surface non-engagingly contacting an inner wall of the transparent outer tube such that one of the rigid inner core and the transparent outer tube may rotate independent of the other, and a second portion of the outer surface recessed from the inner wall; and a plurality of lighting points disposed on the second portion of the outer surface.

2. The dance pole of claim 1 wherein the rigid inner core has a polygonal cross section with flats separated by apexes.

3. The dance pole of claim 2 wherein the flats form the second portion of the outer surface.

4. The dance pole of claim 3 wherein the lighting points are mounted to the flats.

5. The dance pole of claim 4 wherein the lighting points are strips of LEDs.

6. The dance pole of claim 2 wherein the dance pole is supported by a rotatable base.

7. The dance pole of claim 1 wherein sensors disposed between the rigid inner core and transparent outer core are responsive to stimuli.

8. The dance pole of claim 7 wherein characteristics of the lighting points changes responsive to the stimuli.

9. The dance pole of claim 1 wherein the rigid inner core and the transparent outer tube are affixed at a bottom end to a rotating base and at a top end to a rotating housing.

10. The dance pole of claim 9 wherein the dance pole is configured for rotation around bushings and/or bearings at the top end and the bottom end.

11. The dance pole of claim 1 wherein the lighting points are powered by an integral battery.

12. The dance pole of claim 11 wherein the battery is charged via slip rings.

13. The dance pole of claim 1 wherein the lighting points are powered by an external power source.

14. The dance pole of claim 1 wherein one of the rigid inner core and the transparent outer tube is supported by a rotatable base and the other is fixed.

15. The dance pole of claim 1 wherein the rigid inner core is fixed and the transparent outer core is rotatable.

* * * * *